United States Patent [19]

Urabe

[11] Patent Number: 4,990,420

[45] Date of Patent: Feb. 5, 1991

[54] ELECTROPHOTOGRAPHIC PHOTORECEPTOR WITH DOPED SE OR SE ALLOY INTERLAYER

[75] Inventor: Kazayuki Urabe, Nagano, Japan

[73] Assignee: Fuji Electric Co., Ltd., Kawasaki, Japan

[21] Appl. No.: 389,856

[22] Filed: Aug. 4, 1989

[30] Foreign Application Priority Data

Aug. 5, 1988 [JP] Japan ..... 63-195483
Aug. 5, 1988 [JP] Japan ..... 63-195491

[51] Int. Cl.[5] ..... G03G 5/47; G03G 5/14

[52] U.S. Cl. ..... 430/58; 430/63; 430/95

[58] Field of Search ..... 430/57, 58, 63, 95

[56] References Cited

U.S. PATENT DOCUMENTS 3,647,427 3/1972 Harada et al. ..... 430/57
3,801,966 4/1974 Terao ..... 430/57 X
4,170,476 10/1979 Sadamatsu et al. ..... 430/95
4,463,279 7/1984 Shidara et al. ..... 430/95 X

FOREIGN PATENT DOCUMENTS 57-45551 3/1982 Japan ..... 430/95
59-121051 7/1984 Japan ..... 430/57
59-198465 11/1984 Japan ..... 430/57
60-76750 5/1985 Japan ..... 430/57

*Primary Examiner*—Roland Martin
*Attorney, Agent, or Firm*—Brumbaugh, Graves, Donohue & Raymond

[57] ABSTRACT

In an electrophotographic photoreceptor, a layer is interposed between the electroconductive substrate and the surface photosensitive layer or between the carrier transport layer and the carrier generation layer of the photosensitive layer, said layer being made of an Se-As alloy, Se-Te alloy, or pure Se incorporated with any of Ga, In, Zn, Au, Ag, C, Pt, Ge, Pb, and Sb to reduce the band gap. This layer increases the efficiency of hole injection from the substrate, resulting in the rapid decay of negative charging.

8 Claims, 2 Drawing Sheets

ELECTROPHOTOGRAPHIC PHOTORECEPTOR WITH DOPED SE OR SE ALLOY INTERLAYER

BACKGROUND OF THE INVENTION

The present invention relates to an electrophotographic photoreceptor which has an electroconductive substrate and a photosensitive layer of amorphous selenium based material formed on the substrate, said photoreceptor being designed for the reversal development process.

The electrophotographic photoreceptor (referred to hereinafter as "photoreceptor") is a device comprising an electroconductive substrate of an aluminum alloy or the like and a photosensitive layer of a photoconductive material formed on the substrate. Where the photoreceptor of this type is used for a printer, it is usually run by the reversal development process which employs the positive corona discharge for charging and the negative corona discharge for transfer. This process consists of the following steps: First, the photosensitive layer is positively charged by positive corona discharge in the dark. The charged surface is then irradiated (exposed) with laser light corresponding to an image. The irradiated parts decrease in potential, giving rise to the highlight potential, and the unirradiated parts retain the charge, giving rise to the shadow potential. In this way, an electrical image or an electrostatic latent image is formed. Then, a positively charged toner is deposited on the highlight parts having a lower potential in the developer. The toner is transferred to paper which is subjected to negative corona discharge on its reverse side. The transferred toner is fixed thermally or chemically, and the toner which has remained untransferred on the photosensitive layer of the photoreceptor is removed by a fur brush or blade in the cleaning step. The remaining charge is then removed by means of light or alternating current, and the cycle is repeated from step one.

A photoreceptor of this type is directly exposed, during transfer, to negative corona discharge through the perforation of continuous form paper or the intervals of single sheet feed. As a result, the photoreceptor itself becomes negatively charged. If this negative charge is excessively high, the photoreceptor becomes less receptive to positive charging, causing the highlight potential and shadow potential to decrease. This results in a difference in printing density which occurs at the time of transfer between the part covered by paper and the part not covered by paper, thus adversely affecting the printing quality.

In the case of a photoreceptor made of an amorphous selenium-based material, the negative charge which has occurred at the perforations or intervals of paper by negative corona discharge at the time of transfer does not decay easily on account of the low mobility of electrons. It is believed that the decay of negative charge is by the mechanism in which holes are injected from the substrate and move to the surface by the action of an electric field to cancel out the negative charge on the surface.

There is known a photoreceptor which has a single photosensitive layer or a double-layered structure, consisting of a carrier transport layer adjacent to the substrate and a carrier generation layer. Such a photoreceptor is poor in negative charging characteristics because there exists an insulating oxide film in the interface between the substrate and the photosensitive layer or carrier transport layer which lowers the injection of holes; and because of the low mobility of holes in the carrier transport layer.

It is an object of the present invention to solve the above-mentioned problems and improve the efficiency of hole injection between the carrier transport layer and carrier generation layer, thereby providing an electrophotographic photoreceptor having good negative charging characteristics.

SUMMARY OF THE INVENTION

The above-mentioned object of the present invention is achieved by an electrophotographic photoreceptor having an electroconductive substrate and a plurality of layers of different amorphous selenium-based materials laminated on said substrate, characterized in that one of the layers, referred to as an "additional layer", has a thickness of 0.01 to 5 μm and is made of a material composed of selenium or a selenium-based alloy. The selenium or selenium based alloy may have one of the following compositions: a selenium-arsenic alloy containing 0.01 to 5 atom % arsenic, the remainder being selenium; a selenium-arsenic alloy containing 5 to 45 atom % arsenic, the remainder being selenium; pure selenium; or a selenium-tellurium alloy containing up to 10 atom % tellurium, the remainder being selenium. In addition, any of the above selenium or selenium-based alloys may contain 10 to 2500 ppm by weight of halogen. The above composition is incorporated with 10 atom ppm to 5 atom % of an element selected from the group consisting of gallium, indium, zinc, gold, silver, carbon, platinum, germanium, lead and antimony. The additional layer is either an undercoat layer adjacent to the electroconductive substrate or a hole injection layer formed between the carrier transport layer and the carrier generation layer.

According to the present invention, the undercoat layer is interposed between the substrate and the outer photosensitive layer, or the hole injection layer is interposed between the carrier transport layer and the carrier generation layer. The undercoat layer and hole injection layer have novel compositions as described above, which compositions act to reduce the band gap. When used as a undercoat layer, the composition of the additional layer increases the efficiency of hole injection from the substrate to the photosensitive layer. When used as a hole injection layer, the composition of the additional layer increases the efficiency of hole injection between the carrier transport layer and the carrier generation layer. The effect of both of the above is the rapid decay of negative charge.

DETAILED DESCRIPTION OF THE INVENTION

Figure 1A:
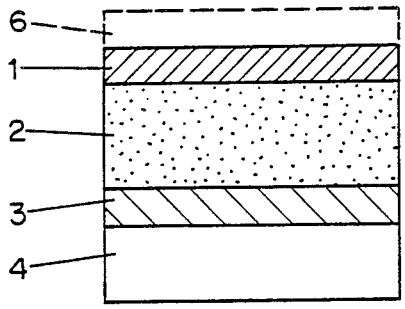
FIGS. 1(*a*) and 1(*b*) are schematic sectional views showing the structure of the two photoreceptors in an embodiment of the present invention.
Figure 1B:
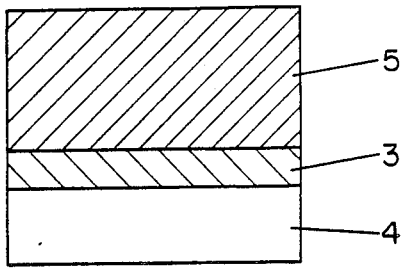

FIGS. 1(*a*) and 1(*b*) are schematic sectional views showing the structure of the photoreceptor having the undercoat layer according to an embodiment of the present invention. The photosensitive layer shown in FIG. 1(*a*) consists of the carrier generation layer 1 (the outermost layer) which generates the hole electron pair upon exposure; the carrier transport layer 2 which helps holes to move easily to the substrate 4 in the case of a selenium-based photosensitive layer; and the undercoat layer 3 of the invention interposed between the carrier transport layer 2 and the aluminum substrate 4. In the case where the carrier generation layer 1 is made of an Se-As alloy having a composition of $As_2Se_3$ or a similar composition, the carrier transport layer 2 is made of an Se-As alloy containing a smaller amount of As than said alloy. However, the carrier generation layer and carrier transport layer may be replaced with a single layer 5 made of amorphous $As_2Se_3$. Such a photoreceptor is shown in FIG. 1(*b*). It is possible that both the carrier generation layer 1 and carrier transport layer 2 are made of pure Se or an Se-Te alloy, with the carrier generation layer containing more Te than the carrier transport layer. There may be another embodiment where the carrier generation layer is provided with an overcoat layer 6 to increase the environmental resistance and durability.

Figure 2:
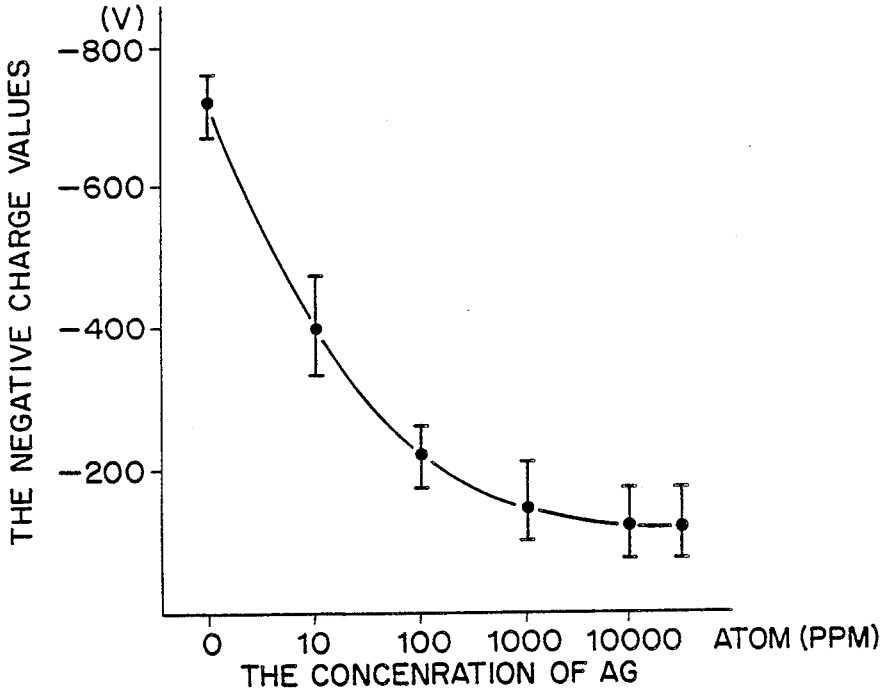
FIG. 2 is a graph showing the relationship between the negative charge value and the concentration of Ag added, which was observed in the photoreceptor (of function-separate type) having the undercoat layer made of a low-As Se-As alloy incorporated with Ag.

In an embodiment of the present invention, the substrate 4, which was an aluminum cylinder, 242 mm in diameter and 460 mm long, was coated with an undercoat layer 3, about 1 μm thick, by flash deposition in a high-vacuum deposition apparatus containing granules composed of 1 atom % of As, 99 atom % of Se, and varied amounts up to 1 atom % of Ag. The undercoat layer was further coated with the carrier transport layer 2, 60 μm thick, composed of 4 atom % of As and 96 atom % of Se from a resistance-heated evaporation source. Finally, a 0.5 μm thick carrier generation layer 1 composed of 30 atom % of Te and 70 atom % of Se and a 1 μm thick overcoat layer 6 made of $As_2Se_3$ were laminated consecutively by flash deposition. The thus prepared photoreceptor has a structure as shown in FIG. 1(*a*). The negative charge value of the photoreceptor which depends on the concentration of Ag in the coating layer is shown in FIG. 2. Negative corona discharging was performed such that the current flowing into the substrate without coating was 300 μA and the negative charge value was measured when the substrate turning at a rate of 60 rpm came to a position 70 ° away from the charger.

In another embodiment of the present invention, a photoreceptor of the structure as shown in FIG. 1(*b*) was prepared by forming the undercoat layer 3 containing a different amount of Ag as mentioned above and then forming, by deposition, the single photosensitive layer 5 of amorphous $As_2Se_3$ about 60 μm thick. The dependence of negative charge value of Ag amount was measured as mentioned above. The results are shown in FIG. 3.

Figure 3:
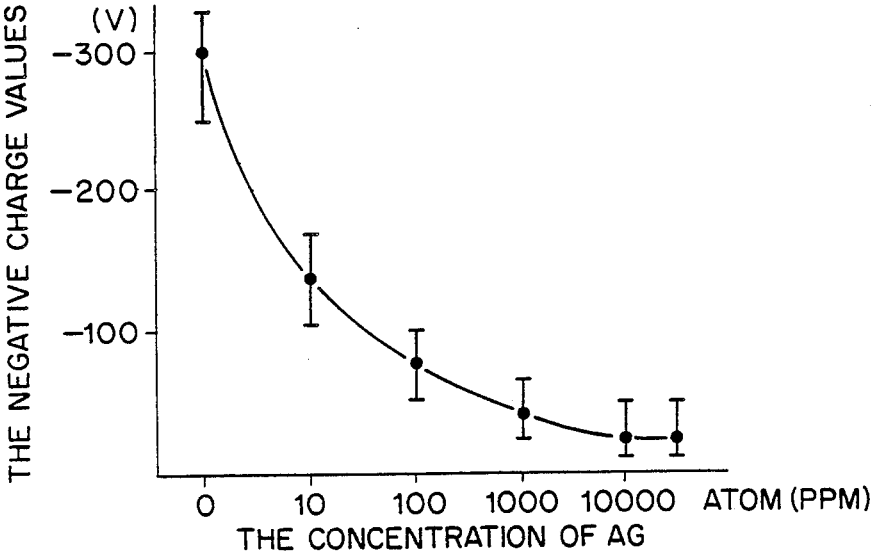
FIG. 3 is a graph showing the relationship between the negative charge value and the concentration of Ag added, which was observed in the photoreceptor (of single photosensitive layer type) having the same undercoat layer as mentioned above.

It is noted from FIGS. 2 and 3 that the negative charge values decline steeply until the concentration of Ag exceeds 100 atom ppm, decline slowly at the concentrations in the order of thousands of atom ppm, and level off at the concentrations of 1–5 atom %.

Figure 4:
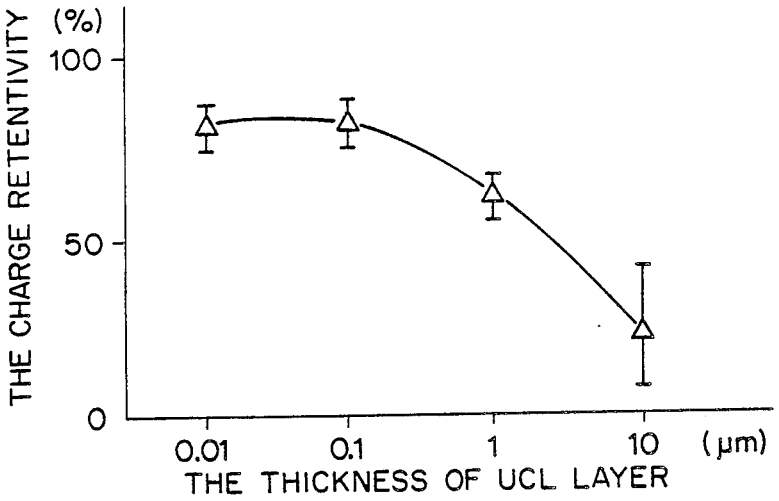
FIG. 4 is a graph showing the relationship between the charge retentivity and the undercoat layer thickness which was observed in the same embodiment as in the case of FIG. 2.
Figure 5:
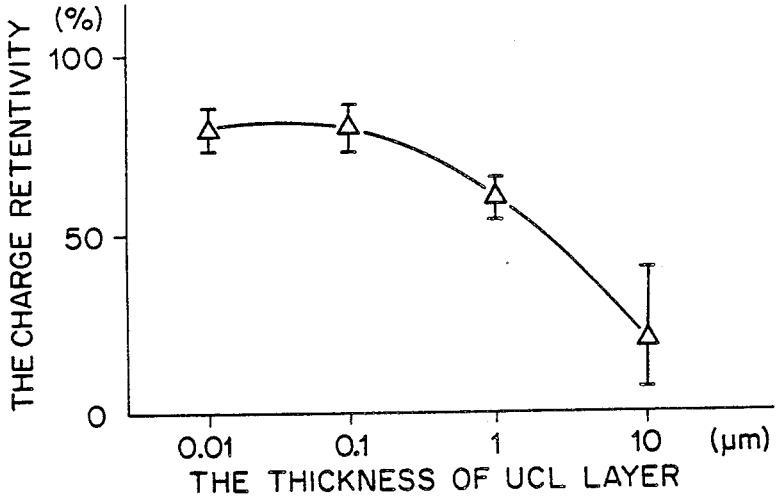
FIG. 5 is a graph showing the relationship between the charge retentivity and the undercoat layer thickness which was observed in the same embodiment as in the case of FIG. 3.

Photoreceptors of the structure as shown in FIGS. 1(*a*) and 1(*b*) were prepared in the same manner as mentioned above, except that the undercoat layer was formed in varied thickness by flash deposition from an Se-As alloy (Se 99 atom % and As 1 atom %) incorporated with 100 atom ppm of Ag. The resulting photoreceptors were examined for the relationship between the retentivity and the coating thickness. The retentivity was expressed in terms of voltage which had remained about 1 second after charging of about 900 V, with the current flowing into the substrate controlled at 60 μA. The results are shown in FIGS. 4 and 5. The thickness of the undercoat layer should desirably be smaller than 5 μm, because the retentivity becomes poor as the thickness approaches 10 μm. The lower limit of the thickness that can be controlled by flash deposition or electron beam deposition is 0.01 μm.

The same results as in FIGS. 2 to 5 were obtained when the undercoat layer was made from Se-As alloys incorporated with 0.01 to 5 atom % of As. In addition, the same results were obtained when Ag was replaced by 10 atom ppm to 5 atom % of an element selected from Ga, In, Zn, Au, C, Pt, Ge, Pb, and Sb.

Moreover, the same results as mentioned above were obtained when the undercoat layer was made of one of the following materials incorporated with an element selected from Ga, In, Zn, Au, Ag, C, Pt, Ge, Pb, and Sb, which reduces the band gap: an Se-As alloy (Se and 0.01–5 atom % of As) containing 10–2500 ppm (by weight) of halogen (e.g., Cl and I); an Se-As alloy (Se and 15–45 atom % of As) containing 10–2500 ppm (by weight) of halogen; pure selenium; a Te-Se alloy (Se and up to 10 atom % of Te); and a Te-Se alloy (Se and up to 10 atom % of Te) containing 10–2500 ppm (by weight) of halogen.

Figure 6A:
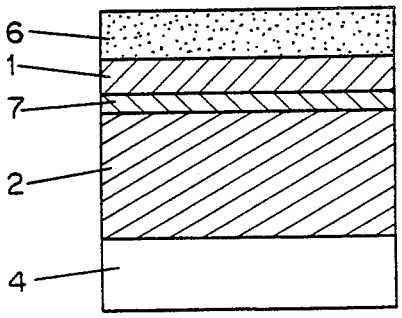
FIGS. 6(*a*) and 6(*b*) are schematic sectional views showing the structure of the two photoreceptors in another embodiment of the present invention.
Figure 6B:
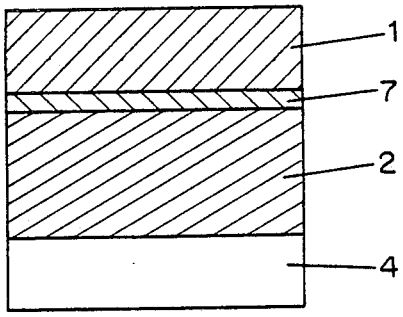

FIGS. 6(*a*) and 6(*b*) schematically show the sectional structure of the photoreceptor having the hole injection layer according to an embodiment of the present invention. The same layers as those in FIG. 1 are indicated by the same symbols. The hole injection layer 7 is interposed between the carrier generation layer 1 and the carrier transport layer 2 so that holes injected from the substrate 4 are efficiently injected from carrier transport layer to carrier generation layer. In addition, the carrier generation layer 1 is covered with the overcoat layer overcoat layer 6 to increase the environmental resistance and durability. The one shown in FIG. 6(*b*) is not provided with the overcoat layer 6.

In another embodiment of the present invention, the substrate 4, which was an aluminum cylinder, 242 mm in diameter and 460 mm long, was coated with a carrier transport layer 2 of Se-As alloy containing 4 atom % of As, 60 μm thick, by flash deposition from a resistance-heated evaporation source in a high-vacuum deposition apparatus. The carrier transport layer 2 was further coated with a hole injection layer 7, 1 μm thick, by flash deposition from granules of Se-As alloy (containing 1 atom % of As) incorporated with varied amounts of In as an impurity. (The hole injection layer may also be formed by electron beam codeposition from an Se-As alloy incorporated with In.) Finally, a 0.5 μm thick carrier generation layer 1 of an Se-Te alloy containing 30 atom % of Te and a 1 μm thick overcoat layer 6 of $As_2Se_3$ were laminated consecutively by either flash deposition, codeposition, or resistance heating deposition. Thus there was obtained the photoreceptor having a structure as shown in FIG. 6(*a*). Separately, the photoreceptor as shown in FIG. 6(*b*), which is not provided with the overcoat layer, was also prepared. The photoreceptor as shown in FIG. 6(*a*) was examined for the dependence of the negative charge value on the concentration of In in the hole injection layer, in the same manner as used to examine the photoreceptor as shown in FIG. 1(*a*) for the dependence of the negative charge value on the concentration of Ag in the undercoat layer. The same results as shown in FIG. 2 were obtained. The photoreceptor as shown in FIG. 6(*b*), which does not have the overcoat layer but has the 2 μm thick carrier generation layer 1 of $As_2Se_3$ on the hole injection layer 7, was examined for the dependence of the negative charge value on the concentration of In in the hole injection layer, in the same manner as used to examine the photoreceptor as shown in FIG. 1(*b*) for the dependence of the negative charge value on the concentration of Ag in the undercoat layer. The same results as shown in FIG. 3 were obtained. In other words, the negative charge values decline steeply until the concentration of In in the hole injection layer exceeds 100 atom ppm, decline slowly at the concentrations in the order of thousands of ppm, and level off at the concentrations of 1–5 atom %.

Then, the carrier transport layer was coated, by flash deposition, with a hole injection layer of varied thicknesses made of an Se-As alloy (99 atom % Se and 1 atom % of As) incorporated with 100 atom ppm of In. The hole injection layer was further coated with the carrier generation layer and overcoat layer, in the same manner as in the above-mentioned embodiment, to give the photoreceptor as shown in FIG. 6(*a*). Alternatively, the hole injection layer was further coated with the carrier generation layer alone, to give the photoreceptor as shown in FIG. 6(*b*). The resulting photoreceptors were examined for the relationship between the retentivity and the coating thickness. The retentivity was expressed in terms of voltage which had remained about 1 second after charging of about 900 V, with the current flowing into the substrate controlled at 60 μA. The same results as shown in FIGS. 4 and 5 were obtained. These results suggest that the thickness of the hole injection layer should desirably be smaller than 5 μm as in the case of undercoat layer.

The same results as mentioned above were also obtained when hole injection layer was made of an Se-As alloy containing a varied amount of As in the range of 0.01 to 5 atom %. In addition, the same results were obtained when In was replaced by 10 atom-ppm to 5 atom % of any of Ga, Zn, Au, Ag, C, Pt, Ge, Pb, and Sb.

Moreover, the same results as mentioned above were obtained when the hole injection layer was made of one of the following materials incorporated with an element selected from Ga, In, Zn, Au, Ag, C, Pt, Ge, Pb, and Sb, which elements act to reduce the band gap. An Se-As alloy (Se and 0.01–5 atom % of As) containing 10–2500 ppm (by weight) of halogen (e.g., Cl and I); an Se-As alloy (Se and 15–45 atom % of As) containing 10–2500 ppm (by weight) of halogen; pure selenium; a Te-Se alloy (Se and up to 10 atom % of Te); and a Te-Se alloy (Se and up to 10 atom % of Te) containing 10–2500 ppm (by weight) of halogen.

According to the present invention, a layer is interposed between the electroconductive substrate and the surface photosensitive layer or between the carrier transport layer and the carrier generation layer of the photosensitive layer, said layer being made of an Se-As alloy, Se-Te alloy, or pure Se incorporated with any of Ga, In, Zn, Au, Ag, C, Pt, Ge, Pb, and Sb to reduce the band gap. This layer increases the efficiency of hole injection from the substrate, resulting in the rapid decay of negative charging (less than 20% for the same process). The electrophotographic photoreceptor of the present invention forms a good image of uniform density with only a small difference in density in intervals of sheets of paper.

I claim:

1. An electrophotographic photoreceptor comprising an electroconductive substrate and a plurality of amorphous selenium-based layers laminated thereon, said plurality of layers comprising a photosensitive carrier generation layer, a carrier transport layer, and a hole injection layer located between said carrier transport layer and said carrier generation layer, said hole injection layer having a thickness of 0.01 to 5 μm and comprising selenium or a selenium-based alloy, and from 10 atom-ppm to 5 atom % of an element chosen from the group consisting of gallium, indium, zinc, gold, silver, carbon, platinum, germanium, lead and antimony wherein when said alloy contains tellurium, the tellurium is present in an amount of up to 10 atom %.

2. An electrophotographic photoreceptor comprising an electroconductive substrate and a plurality of amorphous selenium-based layers laminated thereon, said plurality of layers comprising a photosensitive carrier generation layer, and an undercoat layer adjacent to said electroconductive substrate, said undercoat layer having a thickness of 0.01 to 5 μm and comprising selenium or a selenium-based alloy and from 10 atom-ppm to 5 atom % of an element chosen from the group consisting of gallium, indium, zinc, gold, silver, carbon, platinum, germanium, lead and antimony.

3. The photoreceptor of claim 1, wherein said selenium or selenium-based alloy is a selenium-arsenic alloy containing 0.01 to 5 atom % arsenic, with the remainder being selenium.

4. The photoreceptor of claim 1, wherein said selenium or selenium-based alloy is a selenium-arsenic alloy containing 15 to 45 atom % arsenic, with the remainder being selenium.

5. The photoreceptor of claim 1, wherein said selenium or selenium-based alloy is chosen from the group consisting of pure selenium and a selenium-tellurium alloy containing up to 10 atom % tellurium with the remainder being selenium.

6. A photoreceptor of claim 3, wherein said selenium or selenium-based alloy further contains 10 to 2500 ppm by weight of a halogen.

7. The photoreceptor of claim 4, wherein said selenium or selenium-based alloy further contains 10 to 2500 ppm by weight of a halogen.

8. The photoreceptor of claim 5, wherein said selenium or selenium-based alloy further contains 10 to 2500 ppm by weight of a halogen.

* * * * *

UNITED STATES PATENT AND TRADEMARK OFFICE

CERTIFICATE OF CORRECTION

PATENT NO. : 4,990,420

DATED : February 5, 1991

INVENTOR(S) : Kazayuki Urabe

It is certified that error appears in the above-identified patent and that said Letters Patent is hereby corrected as shown below:

Column 6, line 28, after "alloy," insert --wherein when said alloy contains tellurium, the tellurium is present in an amount of up to 10 atom %--;

Column 6, lines 31-33, delete "wherein when said alloy contains tellurium, the tellurium is present in an amount of up to 10 atom %--;

Column 6, line 46, "claim 1" should read --claim 1 or 2--;

Column 6, line 50, "claim 1" should read --claim 1 or 2--;

Column 6, line 54, "claim 1" should read --claim 1 or 2--;

Column 6, line 59, "A photoreceptor" should read --The photoreceptor--.

Signed and Sealed this

Twenty-seventh Day of October, 1992

*Attest:*

DOUGLAS B. COMER

*Attesting Officer*

*Acting Commissioner of Patents and Trademarks*